United States Patent [19]

Gianni

[11] 4,345,386

[45] Aug. 24, 1982

[54] AIR AGITATION DEVICE

[75] Inventor: Carra Gianni, Suzzara, Italy

[73] Assignee: Carra Officine Meccaniche S.p.A., Codissoto de Luzzara, Italy

[21] Appl. No.: 220,919

[22] Filed: Dec. 29, 1980

[30] Foreign Application Priority Data

Dec. 31, 1979 [IT] Italy ..... 3582 A/79

[51] Int. Cl.[3] ..... F26B 9/06

[52] U.S. Cl. ..... 34/218; 34/219; 34/222; 34/223; 34/229; 34/230; 415/70; 416/64; 416/78

[58] Field of Search ..... 34/219, 218, 222, 223, 34/229, 230; 416/64, 78; 415/70

[56] References Cited

U.S. PATENT DOCUMENTS

| | | | |
|---|---|---|---|
| 1,339,131 | 5/1920 | Patrono et al. | 416/111 |
| 4,021,928 | 5/1977 | Johnson | 34/38 |
| 4,182,049 | 1/1980 | Lestraden | 34/222 |
| 4,184,805 | 1/1980 | Arnold | 416/64 |

FOREIGN PATENT DOCUMENTS

| | | |
|---|---|---|
| 313149 | 2/1974 | Austria . |
| 2203029 | 5/1974 | France . |

*Primary Examiner*—Larry I. Schwartz
*Attorney, Agent, or Firm*—Fleit & Jacobson

[57] ABSTRACT

Disclosed herein is an air agitation device that is positioned between two opposite sets of shelves on which the articles to be dried are placed.

The device constitutes two identical crankshafts, oriented in the same direction, that rotate in synchrony with respect to axes perpendicular to the opposite surfaces of the said sets of shelves.

To the crankpins of the said shafts are articulated, on opposite sides, two ventilation frames, each of which provided with a plurality of fins oriented suitably with respect to the said sets of shelves.

The synchronous rotation of the crankshafts renders movable each frame, which oscillates with a harmonic motion in two inter-perpendicular directions, one of which is coincident with the longitudinal axis of the passageway existing between the sets of shelves. The longitudinal harmonic oscillation of each frame causes, on the part of this, a flow of air directed alternately towards the upper and the lower part of one and the other set of shelves, respectively; the contrary occurs for the other frame.

2 Claims, 5 Drawing Figures

AIR AGITATION DEVICE

BACKGROUND OF THE INVENTION

The invention relates to an air agitation device that can be utilized in drying chamber type driers of the constituted by in which opposite sets of shelves are included on which the articles to be dried are placed.

DESCRIPTION OF THE PRIOR ART

As is known, in the drying of articles, the weight G of evaporated water corresponds to $G=C.S_e.(P_s-P_a)B^{-1}t$, *where* $S_e$ is the evaporating surface, $P_s$ is the vapor pressure of the evaporating surface, $P_a$ is the vapor pressure of the evaporating liquid at the temperature at which it is, B is the atmospheric pressure, t the time and C the coefficient of evaporation which hereinafter will be referred to as $C_x$, where x is the variable abscissa of a datum system coinciding with a straight line parallel to the longitudinal axis of the passageway existing between the said sets of shelves, the origin of which coincides with one extremity of the said passageway. It is also known that $C_x=C_o+K\,V_x^{\frac{1}{2}}$, where $C_o$ is evaluated at nil velocity, K is an experimental constant and $V_x$ is the velocity at the abscissa x. At the present time, in order to agitate the air, use is made of fans, carried by a carriage movable alternately in the two directions, provided with at least two impellers that generate opposite flows of air, or with at least one impeller, the rotation direction of which is periodically reversed.

With Q being the delivery of the air generated by the said fans (or by the said fan, in cases when only one is used) that hereinafter shall be deemed constant, and S the section affected by the flow of air generated by the said fans, it follows that $V_x=H_x.Q.S^{-1}$, where to $H_x$ coincides a coefficient variable between zero and one ($0\leqq H_x\leqq 1$) that takes into account the position of the layers of the articles being dried on the sets of shelves ($H_x=1$ for the layer hit directly by the flow of air, and $H_x=0$ for the layers further inside).

Theoretically, the section S can vary between zero and $S_{max}$ ($0\leqq S\leqq S_{max}$), where $S_{max}$ is understood to be the longitudinal section of the said set of shelves.

From the foregoing, the minimum theoretical velocity flow of air corresponds to $V_{min}=Q/S_{max}$.

Since the articles being dried are hit alternately by the flow of air, it is interesting to evaluate the mean value $C_{mx}$ of the coefficient $C_x$ in the interval of time $(t_2-t_1)$ it takes the carriage to effect one complete longitudinal travel.

In the interval of time $\overline{t}=(t_2-t_1).(S_{max}/S)^{-1}$, $V_x$ differs from zero and thus $C_x=C_o+K\,V_x^{\frac{1}{2}}$.

In the interval:

$\overline{\overline{t}}=(t_2-t_1)-\overline{t}=(t_2-t_1)-(t_2-t_1)(S_{max}/S)^{-1}$, $V_x=0$ and thus $C_x=C_o$.

At any one abscissa x, $C_{mx}$ (as can be seen from the mathematical analysis) corresponds to:

$$C_{mx}(t_2-t_1)=$$

$$C_o[(t_2-t_1)-(t_2-t_1)(S_{max}/S)^{-1}]+$$

$$(C_o+K\,V_x^{\frac{1}{2}})\cdot(t_2-t_1)\cdot(S_{max}/S)^{-1};$$

$$C_{mx}=C_o+K\,V_x^{\frac{1}{2}}(S_{max}/S)^{-1}=C_o+K\,(H_x\,V_{min})^{\frac{1}{2}}\cdot(S_{max}/S)^{-\frac{1}{2}}$$

Since:

$$\lim_{V\to\infty} S=\lim_{V\to\infty} Q/V=0$$

$$\lim_{V\to 0} C_{mx}=C_o$$

Moreover $$\lim_{V\ 0} C_x=C_o$$

from which it can be stated that at nil velocity, in the interval of time $(t_2-t_1)$, $C_{mx}=C_x=C_o$.

In the two limit situations, that is to say $V\to\infty$ and $V=0$, $C_{mx}=C_o$: for V halfway between zero and infinite, $C_{mx}$ presents a maximum; since, in fact, the only variable of the expression of $C_{mx}$ is the surface S that appears in the expression $(S_{max}/S)^{-\frac{1}{2}}$, it can be deduced that the maximum value of the said expression equals one unit when $S\to S_{max}$ (that is to say when S coincides with $S_{max}$), and this leads to the conclusion that $(C_{mx})\max=K(V_{min}H_x)^{\frac{1}{2}}=C_o$ when $S=S_{max}$.

It is obvious from the foregoing that it is advisable to increase, compatibly with the delivery Q of the flow of air, the section S affected by the said flow, since $(C_{mx})\max$ depends on $V_{min}=Q/S_{max}$.

In Austrian Pat. No. 313,149 deposited in the name of OFFICINE CARRA, the increase in the section S was achieved through the provision of a fan having an impeller of a diameter equivalent to the height of the sets of shelves. So as to exert an effect on both sets of shelves, the rotation direction of the impeller was periodically reversed by means of time switches.

The aforementioned solution involves the use of a carriage (with corresponding rails and drive means) for supporting the fans, limit switches for inverting the motion of the carriage, and of time switches. Furthermore, the section S of the flow of air generated by the impeller is a lot less than the section $S_{max}$ of the sets of the shelves utilized in the drying chambers of the driers known to date.

SUMMARY OF THE INVENTION

In order to overcome the problems outlined above and to render optimum the coefficient of evaporation between the articles being dried and the flow of air that hits them, the Applicant has engineered an air agitation device that does not require the use of movable supports, time switches or limit switches, wherein there are two opposed flows of air that exert an effect on both the sets of shelves in between which the said device is placed, the sections of this corresponding roughly to half the $S_{max}$ of the longitudinal section of the relevant sets of shelves.

The above mentioned object is attained with the agitation device in question which is positioned in the passageway existing in a drying chamber and at the side of which is provided at least one set of shelves on which the articles to be dried are placed. The essential features of the device in question comprise: at least two crankshafts, one of which, at least, is driven, these crankshafts being identical, oriented in the same direction and rotating with respect to axes perpendicular to the longitudinal surface of the said set of shelves that faces the passageway, and situated in proximity of the extremities of the said passageway; at least two frames articulated to corresponding crankpins of the said crankshafts, and placed on two parallel planes positioned bilaterally to, i.e., on each side of, the main journals of the said shafts and perpendicular thereto; and means of ventilation, carried by the said frames, destined to produce a flow of air in the direction perpendicular to the said longitudinal surface of the set of shelves.

In one preferred form of embodiment, the means of ventilation for each frame constitute a plurality of suitably oriented fins.

The advantages obtained with the invention arise essentially from the fact of two opposite flows of air being created, one per set of shelves, the flow sections corresponding to approximately half the longitudinal section of the corresponding set of shelves. Because of this, for the reasons explained in the introductory part of this text, it is possible to render optimum the mean evaporation coefficient between the articles being dried and the hot air that hits them. Furthermore, the said flows create a circulation of air that affects the articles that are not directly hit by the said flows.

Other advantages consist in the fact that the device in question does not use movable carriages (thereby eliminating the corresponding drive means and reversing switches), that it is constituted with the use of simple, functional mechanics and that it is not at all complex from the maintenance viewpoint.

BRIEF DESCRIPTION OF THE DRAWINGS

The characteristics of the invention are described below with reference to the accompanying drawings that illustrate solely one preferred form of embodiment for the air agitation device in question, and in which.

DESCRIPTION OF THE PREFERRED EMBODIMENT

Figure 1:
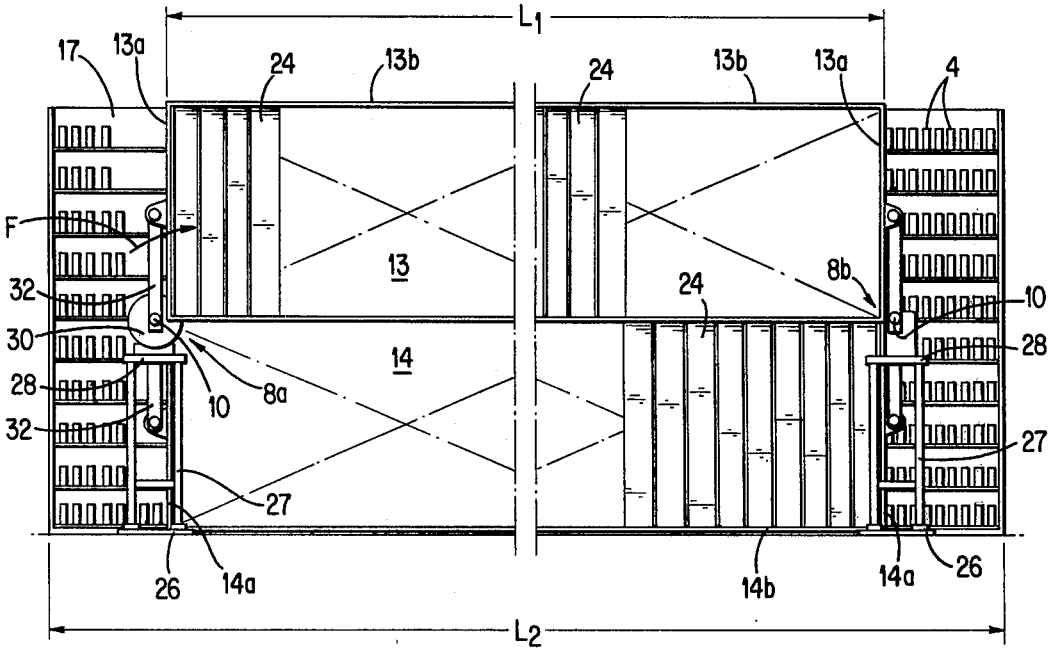
FIG. 1 illustrates, diagrammatically, the front view of the device in question, positioned in the passageway of a drying chamber.

With reference to the above mentioned figures, at 1 has been shown a drying chamber that is heated either directly with hot air heated in accordance with known (non-illustrated) systems or else indirectly through suitable (non-illustrated) exchangers.

At the side of the central passageway 2 in the chamber, two sets of shelves 3*a* and 3*b*, respectively, are provided, on which are placed the articles 4 to be dried (bricks, for example). In the region of the extremities 2*a* and 2*b* of the said passageway, two supports 25*a* and 25*b* are provided, one per extremity. Each of the said supports has its lower part constituted by two base plates 26, its center part by a pair of "H" shaped sections 27, and its top part by a plate 28.

The plate 28 belonging to the support 25*a* sustains a geared motor 30 of a known type provided with two coaxial outlet shafts 31 whose common axis of rotation is perpendicular to the longitudinal surfaces 17 of the said sets of shelves. To the extremities of the said shafts 31 are secured two cranks 32 that are parallel one with the other and extend on opposite sides. The cranks 32 are provided with corresponding crankpins 33 that extend perpendicularly towards the corresponding facing surfaces 17. The assembly constituted by the two coaxial shafts 31, the cranks 32 and their crankpins 33, defines a crankshaft shown at 8*a*.

The plate 28 belonging to the support 25*b* carries the bearings that support the journal of a crankshaft 8*b* that is identical to the aforementioned crankshaft 8*a* and is oriented in exactly the same way as this.

At 13 and 14 there are two identical rectangular frames, the height of which corresponds to half the height "h" of the sets of shelves, and the width $l_1$ of which is approximately equal to the width "$l_2$" of the said sets of shelves. The said frames are positioned along two inter-parallel planes, perpendicular to the axes of rotation 10 of the said crankshafts 8*a* and 8*b*. The center points of the short sides 13*a* of the frame 13 are articulated to two crankpins 33 belonging to two cranks of the said crankshafts that are situated on one and the same side. Likewise, the short sides 14*a* of the frame 14 are articulated, at their central points, to the remaining pair of crankpins.

To the long sides 13*b* and 14*b* of the said frames are secured the extremities of a plurality of fins 24 whose orientation is the same and the longitudinal axes of which are parallel to the short sides 13*a* and 14*a* of the corresponding frames.

The operation of the geared motor 30 causes the rotation (in direction F) of the corresponding crankshaft 8*a* with respect to the shaft 10 and this causes the synchronous rotation also of the crankshaft 8*b* since the said crankshafts are connected one to the other by the said frames 13 and 14.

Since the crankpins 33 describe circumferences, the diameter of which is proportional to "h", it follows that the motion at each point of each frame in the longitudinal direction $m_1$ and in the vertical direction $m_2$ is converted into corresponding harmonic motion of an amplitude equal to one-half "h".

Figure 4:
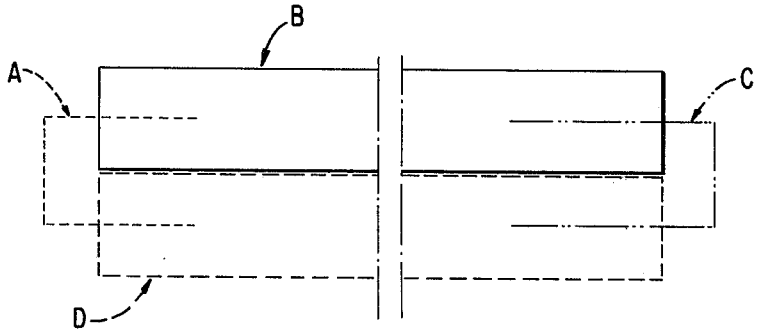
FIG. 4 illustrates, in a lesser scale than in the preceding figures, the diagrammatic front view of one frame of the device in question, in four characteristic positions.
Figure 5:
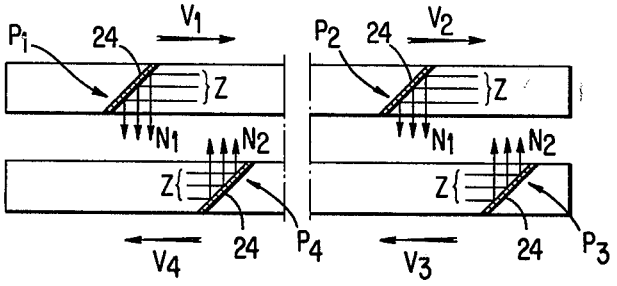
FIG. 5 illustrates, diagrammatically, in a greater scale than in the preceding figures, any one fin, in any four positions of its longitudinal harmonic motion.

When examining, for example, the frame 13, it can be seen that this moves (FIG. 4) from position A (the first dead center point in the longitudinal harmonic motion), to B (the top dead center point in the vertical harmonic motion), to C (the second dead center point in the longitudinal harmonic motion), to D (the bottom dead center point in the vertical harmonic motion) and then back again to position A.

If the longitudinal harmonic motion of any one fin 24 is considered, and for the said motion are considered any four positions $P_1$ (chosen between A and B), $P_2$ (chosen between D and A), the following emerges obviously:

(a) in positions $P_1$ and $P_2$, with the components of the longitudinal velocity of the fin 24 called $V_1$ and $V_2$, it can be seen that the fluid flows Z affected by the main section of the fin, are deviated in direction $N_1$;

(b) in positions $P_3$ and $P_4$, with the components of the longitudinal velocity of the fin (opposite the components $V_1$ and $V_2$) called $V_3$ and $V_4$, it can be seen that the fluid flows Z affected by the main section of the fin, are deviated in direction $N_2$, that is to say the opposite direction to $N_1$.

Figure 2:
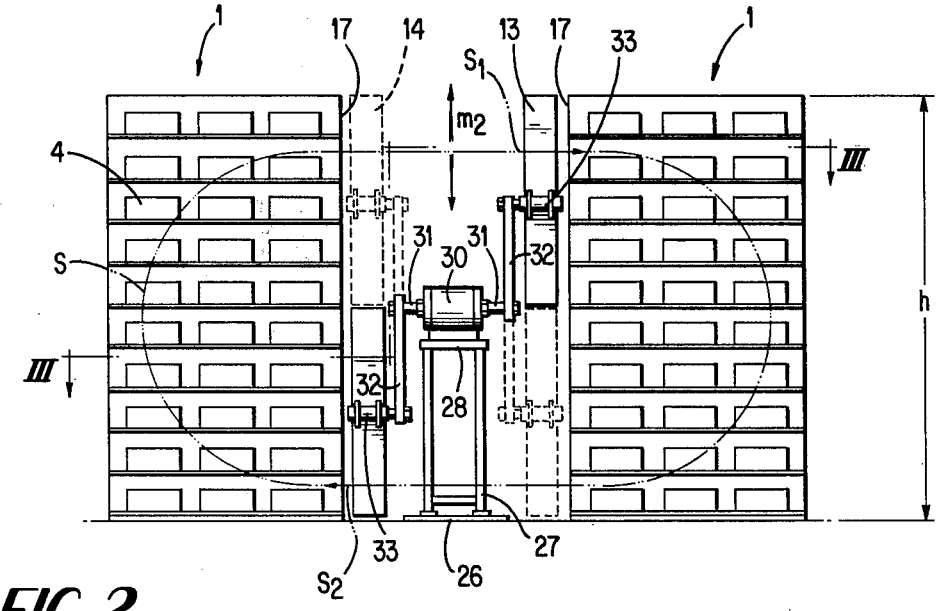
FIG. 2 illustrates, diagrammatically, the lateral view of the device in question, in two positions, one of which shown with continuous lines (corresponding to the view in FIG. 1) and the other with dashes.
Figure 3:
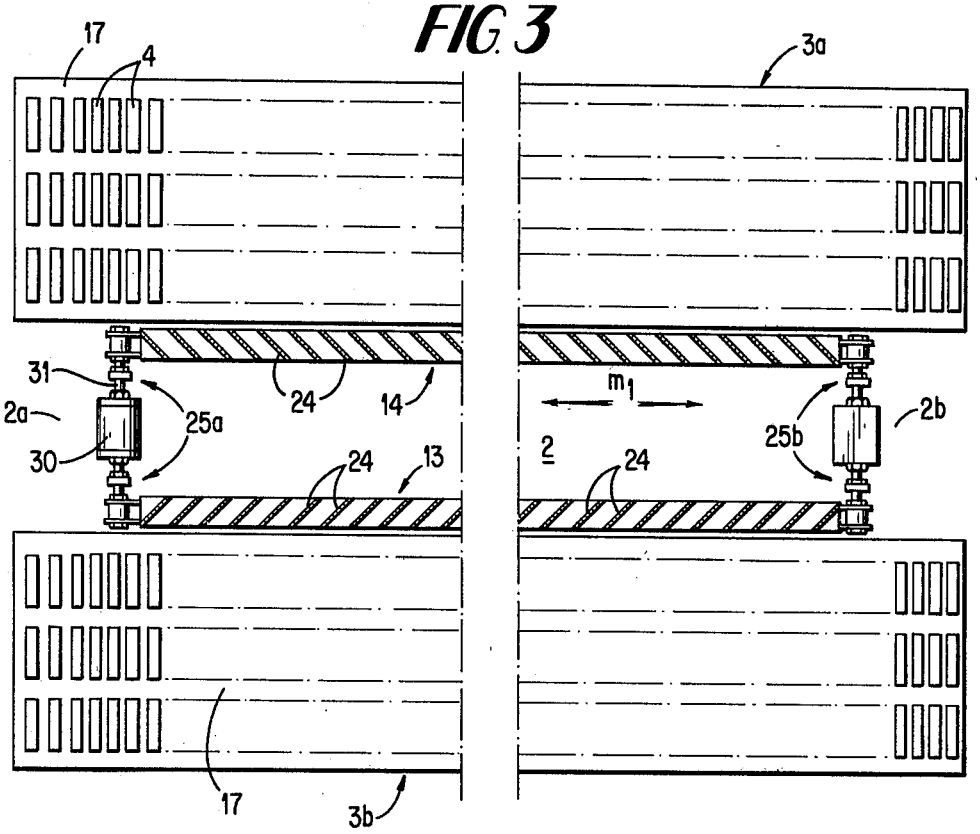
FIG. 3 illustrates, diagrammatically, the view from above of the device in question, in the position corresponding to FIG. 1.

Calling $S_1$ and $S_2$ the flows of air created at any one moment by the frames 13 and 14, respectively, it can be deduced that the said flows of air create a circulation of air S that also affects the articles 4 which, at the above mentioned moment, are not directly hit by the flows $S_1$ and $S_2$ (see FIG. 2).

In conclusion, calling Q/2 the mean delivery of air that the frame 13 produces and despatches towards the set of shelves 3*a*, and also Q/2 the mean delivery of air that the said frame produces and despatches towards the other set of shelves 3*b*, it can be deduced that each set of shelves is hit on an average (because of the contribution of both frames) by a delivery Q. The said delivery Q is, on an average, distributed over a section that differs little with respect to $S_1 = \frac{1}{2}h.l_2$ (where h and $l_2$ are the height and the width of each set of shelves) which corresponds to $S_{max}/2$ where $S_{max} = h.l_1$ (that is to say, the longitudinal surface 17) and this is optimum, with regards to what what stated in the introductory part of this description, for the mean coefficient $C_{mx}$ relevant to the articles being dried, placed on each set of shelves.

What is claimed is:

1. An air agitation device placed in a multiple section drying chamber having a central passageway between shelf sections, the device positioned in the passageway existing between two opposite sets of shelves on which articles to be dried are placed, the air agitation device comprising: at least two crankshafts, each having a crankpin, said crankshafts being identical, oriented in the same direction and rotating with respect to axes perpendicular to the longitudinal surfaces of said sets of shelves that face the passageway, and situated in proximity of the extremities of the said passageway; motor means for driving at least one of said crankshafts; journal means allowing the rotation of said crankshafts about said perpendicular axes; at least two frames articulated to corresponding crankpins of the said crankshafts, and placed on two parallel planes positioned one on each side of said journal means of the said crankshafts and perpendicular to the said journal means; and means of ventilation, carried by the same frames, for producing a flow of air in the direction perpendicular to the said longitudinal surfaces of the sets of shelves.

2. Device according to claim 1, wherein the said means of ventilation are constituted, for each frame, by a plurality of fins.

* * * * *

UNITED STATES PATENT AND TRADEMARK OFFICE

CERTIFICATE OF CORRECTION

PATENT NO. : 4,345,386

DATED : Aug. 24, 1982

INVENTOR(S) : Gianni CARRA

It is certified that error appears in the above-identified patent and that said Letters Patent are hereby corrected as shown below:

On the title page,

Line 2, delete "Gianni" and insert --Carra--

Line 4 should read as follows:

-- [75] Inventor: Gianni Carra, Suzzara, Italy --

Line 6, delete "Codissoto de" and insert

-- Codisotto di --

Col. 2, line 10 should read:

$$\lim_{V \to 0} C_x = C_o$$

Signed and Sealed this

Fifteenth Day of February 1983

[SEAL]

Attest:

GERALD J. MOSSINGHOFF

Attesting Officer

Commissioner of Patents and Trademarks